United States Patent [19]

DeZuba

[11] 4,038,858

[45] Aug. 2, 1977

[54] CERAMIC DIE AND METHOD OF USING SAME

[75] Inventor: James M. DeZuba, Houston, Tex.

[73] Assignee: Rose M. DeZuba, Houston, Tex.

[21] Appl. No.: 682,360

[22] Filed: May 24, 1976

Related U.S. Application Data

[63] Continuation-in-part of Ser. No. 524,076, Nov. 15, 1974, abandoned.

[51] Int. Cl.[2] ..... B21C 3/00

[52] U.S. Cl. ..... 72/274; 72/467

[58] Field of Search ..... 72/467, 468, 274

[56] References Cited

U.S. PATENT DOCUMENTS

| | | | |
|---|---|---|---|
| 1,096,688 | 5/1914 | Dantsizen | 72/467 X |
| 2,150,734 | 3/1939 | Unckel | 72/467 |
| 3,109,663 | 11/1963 | Phillips, Jr. | 279/41 |
| 3,178,925 | 4/1965 | Nolan et al. | 72/467 X |

*Primary Examiner*—Milton S. Mehr

*Attorney, Agent, or Firm*—Guy E. Matthews

[57] ABSTRACT

A complete all-ceramic die for use in wire-drawing operations includes a new and novel approach zone, bearing zone and back relief to thereby eliminate lubrication of the die and unwanted lubrication dust and wire scales.

11 Claims, 7 Drawing Figures

FIG. 1
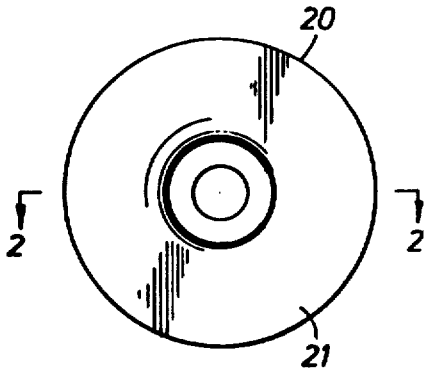
FIG. 2
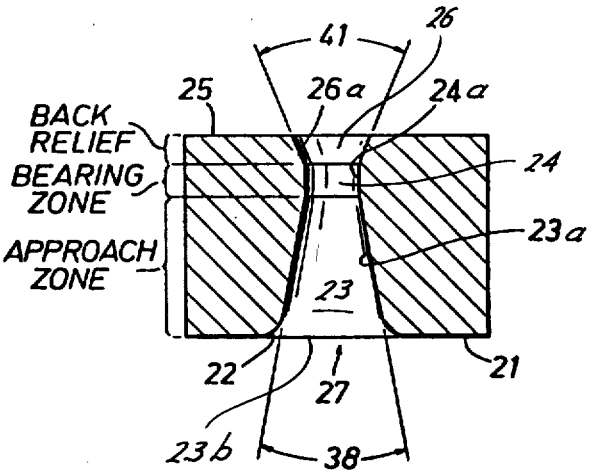
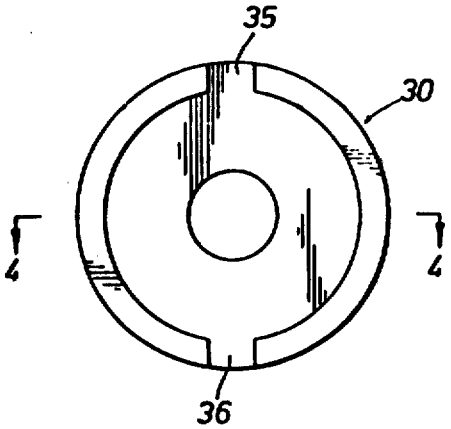
FIG. 3
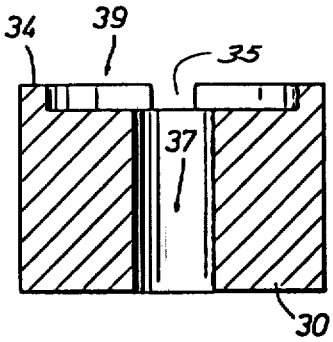
FIG. 4
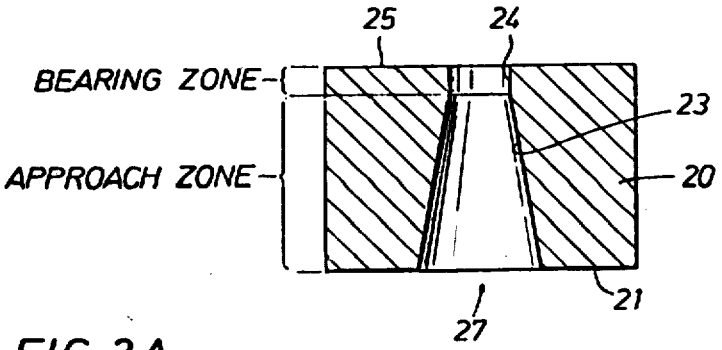
FIG. 2A

CERAMIC DIE AND METHOD OF USING SAME

RELATIONSHIP TO OTHER APPLICATIONS

This application is a continuation-in-part of a copending application, Ser. No. 524,076, filed Nov. 15, 1974, entitled "Ceramic Die and Method of Using Same", now abandoned.

BACKGROUND OF THE INVENTION

This invention relates to wire-drawing dies.

Heretofore, in the drawing of wire through one or more dies, a whole series of metallic dies or dies containing nibs, such as disclosed in U.S. Pat. Nos. 2,150,734 and 3,178,925 or die holders, such as disclosed in 3,109,663 have been employed for continually reducing the cross-sectional diameter of the wire being drawn.

Usually such dies may contain as many as one to fifteen die stands containing dies for continually reducing the cross-sectional diameter of the wire through drawing operations. It can be appreciated that if one of such dies overheats, chips, or in any manner some defect occurs in such die, that a defect will occur in the wire being drawn therethrough to thus render the wire worthless and unusable.

At the present time, lubricant is used to attempt to enable the wire to be forced or pulled through the die opening to lubricate for longer die life or to attempt to cool the die continuously as the wire is pulled or forced through.

Further, at the present time, when wire is being forced or drawn through dies, there is a large amount of dust, soot, or soap dust, scales generated when such wire is drawn or pulled through the die which constitutes a health hazard and further constitutes a serious problem of cleanliness since such scale dust usually is spread throughout the machinery in the wire-drawing plant.

At the present time the numeral draft of carbide dies begins in the range of 0.018 to 0.025 or .028 thousandths of an inch. This draft means that to begin wire-drawing operations, the first diameter opening through the die is from 0.018 to 0.025, etc. thousandths of an inch. Such numeral draft diameter indicates that it is necessary to have further die stands placed in the wire-drawing operations for continually attempting to reduce the size of the cross sectional diameter of the wire and further also means that such wire-drawing operations have heretofore taken a longer time because of the number of wire drawing stands through which the wire must pass until the proper cross-sectional diameter is obtained.

The prior art also discloses various compositions of non-metallic materials used in ceramic dies; however, such dies have also been disclosed, for example in U.S. Pat. No. 3,469,436 as die nibs or inserts in extrusion dies for the purpose of extruding metals through such combination dies. The application of this type of ceramic dies has been limited because of the brittle nature of the materials used and has often resulted in very short surface life for such dies which this causes increased costs throughout the industry.

SUMMARY OF THE INVENTION

The present invention relates to a new and improved ceramic die and method of using same wherein the life of the die is greatly increased without lubrication.

DRAWINGS

Other aspects of the invention will become apparent from the following description and accompanying drawings wherein:

FIG. 1 is a rear view of the die of the present invention;

FIG. 2 is a cross-sectional view of the die illustrated in FIG. 1;

FIG. 2A is a cross-sectional view taken along 2–2 of FIG. 1;

FIG. 3 is a plane view of a pressure or back die which may be used in conjunction with the die of FIG. 1;

FIG. 4 is a sectional view taken along lines 4–4 of FIG. 3;

DESCRIPTION OF THE PREFERRED EMBODIMENT

Figure 5A:
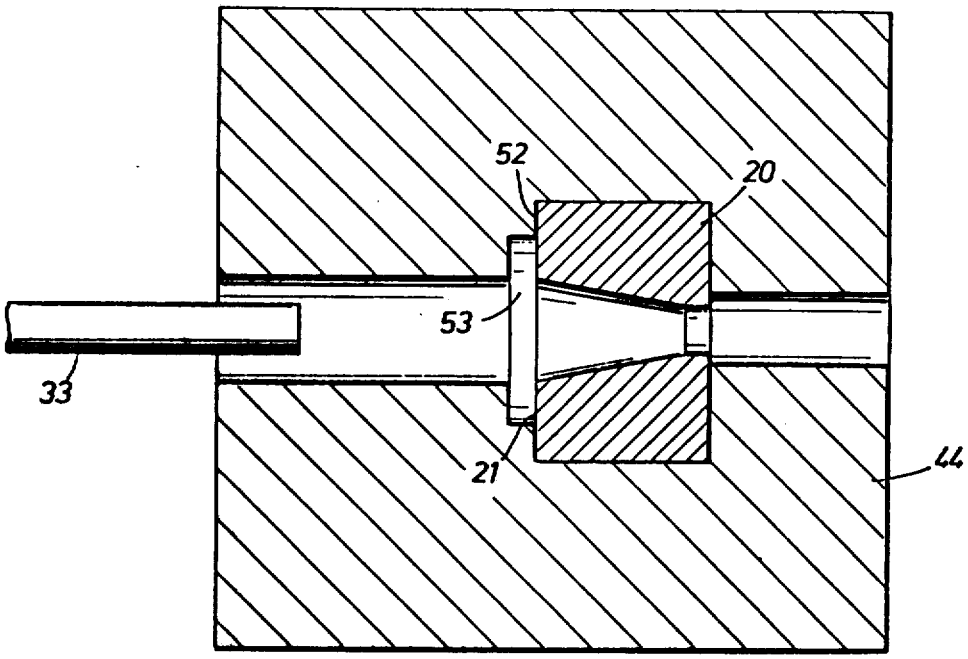
FIG. 5A is a cross-sectional view of an alternative embodiment of a die box illustrated in FIG. 5.

The present invention relates to an all-ceramic die which requires no lubrication and which eliminates metal scales and the like from wire-drawings operations. The die, although not limited herein, is normally manufactured from high-quality aluminum oxide (for example, between 70 percent and 99.97 percent aluminum oxide) because it has been found by applicant that aluminum oxide has a characteristic of high heat resistence and dissipation which, when used with wire-drawing operations, enables the elimination of lubrication while at the same time preventing this die from chipping and the like.

Applicant's dies are generally cylindrical in construction although they may be of any other appropriate form and include an approach zone, bearing zone and back relief zone as will be set forth hereinbelow. It has been found by applicant that the use of ceramic materials a die having high heat dissipation characteristics along with a new and novel approach zone angle relative to the bearing zone eliminates the necessity for lubrication which will save the wire-drawing industry millions of dollars and due to the fact that soot, dust, and scales are not produced from the wire-drawing operations, the industry will further be saved millions of dollars because of the elimination of requirements for eliminating environmental health and working problems and conditions.

It has also been found that the die of the present invention has a longer surface or working life than other dies and, due to the unique nature of the die, a larger draft or reduction in cross-sectional wire size may be accomplished than with normal standard dies which thus eliminates the usual number of wire-drawing stands which are normal to present wire-drawing operations.

Further in the all ceramic die of the present invention, wear on the interior of the die due to wire-drawing is usually even such that the die of the present invention can be used for continually larger and larger drafts.

As illustrated in FIG. 1, a wire-drawing die embodying the present invention with a passage 27 therethrough illustrates a generally circular configuration. The external shape of the die is not material, since the actual reduction in wire size as a result of the drawing operation is accomplished by a combination of the configuration of passage 27 and the die material.

Referring to FIG. 2, the wire passage 27 through the die 20 includes an approach zone 23 having tapered side walls 23*a* opening into the entrance face or opening 23*b* of the entrance side 21 of die 20, bearing zone 24 and a back relief zone 26. In order to facilitate manufacture of the die 20, and as illustrated in FIG. 2, the intersection of surface 21 and side walls 23*a*, a rounded or smoothed intersection 22 is machined. Side walls 23*a* are generally tapered, having an included angle 38 of from about 17° to 30 through the approach zone 23. Immediately thereafter and forming a continuation of zone 23 thereof is the bearing section 24, defined by walls 24*a*. At the exit or rear surface 25 of die 20 is a back relief zone 26 defined by walls 26*a* having an included angle 41 of approximately 45°.

As illustrated in FIG. 2 the diameter of bearing zone 24 is substantially equal and constant throughout the length thereof with the bearing surface being of generally cylindrical configuration. As applicant has calculated the longitudinal length of the bearing portion 24 for the entrance angle 38 of 17° to 30° should be approximately 25 percent to 40 percent of the diameter of the finished wire.

The deformation of the wire is initiated in the approach zone 23 at a point where the diameter of the tapered walls 23*a* contacts the diameter of the wire drawn into opening 23, with final shaping and elongation of the wire (not shown) occurring in the bearing zone 24. The unique combination of the included angle 38 of the tapered approach zone 23 and the longitudinal length of the bearing surface walls 24*a* contribute to the extended service life of the die by dissipating heat in the die 23 and further eliminating lubrication of the die 23.

As previously discussed, one of the general requirements in wire-drawing operation using conventional dies is the necessity for a constant supply of lubricant at the wire/die interface. This supply of lubricant costs money and creates many problems, including disposal of the used lubricant in conformance with environmental considerations. In order to maintain sufficient lubricity in the standard die, a great quantity of lubricant is used, and may increase the cost of the wire-drawing operation by as much as $12–18,000 for a typical five-die wire drawing machine or stand on a yearly basis. One of the surprising characteristics of the die of the present invention is the elimination of lubrication of the die due to the purity of oxide used in combination with the calculated tapered approach zone 23 and bearing zone 24, shown in FIG. 2A. That is, wire may be drawn through die 20 without lubricant, while effecting a larger reduction in the cross-sectional dimension of the wire than is possible with conventional dies. For example, when drawing mild steel wire of an initial diameter of 0.025 inches (5-rod), the wire may be drawn through die 20 without lubrication while reducing the diameter of the wire by as much as 0.037 inches – 0.041 inches through bearing surface or zone 24 while the commonly employed carbide die is limited to a draft diameter of about 0.025 inches – 0.028 inches. Obviously, in the use of a series of dies each having greater draft diameter, a reduction in the number of die stands required for a specified reduction in wire size is accomplished.

Figure 5:
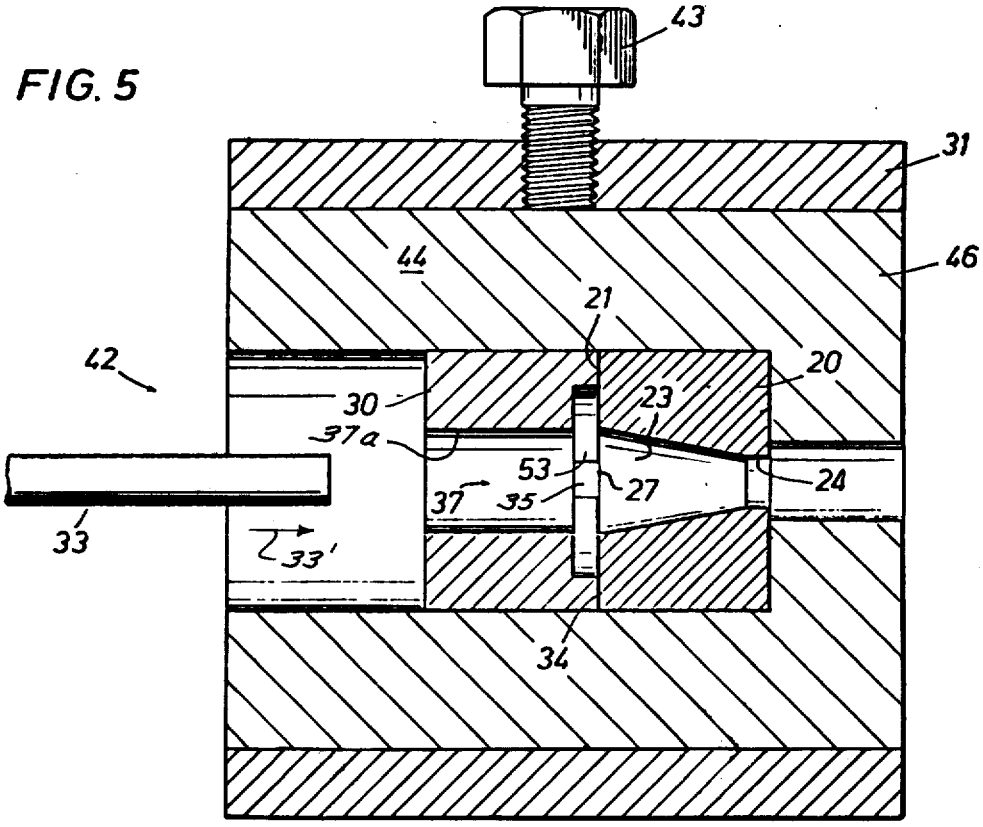
FIG. 5 is a sectional view containing a pressure or back die and a drawing die.

As illustrated in FIG. 5, a drawing die 20 is mounted in combination with a pressure die 30 and a die box or die holder 31. As illustrated in FIGS. 3 and 4, the pressure die 30 is generally circular in construction and of the same approximate external size as drawing die 20. Downstream face 39 of die 30 includes a raised rim 34 extending substantially around the perimeter of the die with grooves or slots 35 and 36 cut therein, the rim 34 engaging the face 21 of die 20 (FIG. 5).

In the embodiment illustrated in FIG. 5, pressure die 30 is contained within die holder 31 together with drawing die 20. Wire 33, which is to be drawn to a smaller diameter, enters the die assembly 42 and moves in the direction of the arrow 33 and first encounters pressure die 30. Passage 37 through die 30 is larger than wire 33 and serves to guide wire 33 to drawing die 20. Wire 33 is stabilized by passage 37, that is, in the event of wire 33 having a tendency to bend from its longitudinal axis parallel to passage 37, wire 33 will engage the side walls 37*a* of passage 37, thereby enabling wire 33 to enter drawing die 20 through opening 27 and into passage 23.

Means 43 for holding the pressure die 30 and drawing die 20 within die holder 31, may comprise a suitable hold down screw threadably engaged with die holder 31, and when tightened thereby causes screw 43 to increase pressure against die holder insert 46 which in turn increases pressure against dies 20 and 30 to hold members 20 and 30 together.

And alternative embodiment of die assembly 42 is shown in FIG. 5*a* wherein pressure die 30 of FIG. 5*a* is integrally machined with die holder 44. Suitable access to the interior of the die holder 44 for the insertion of die 20 may be provided as for example hinging of die holder 44 along the longitudinal axis in a direction parallel to wire travel (not shown).

Referring again to FIG. 5, in the wire-drawing operation there is often scale on the surface of wire 33 which flakes off and enters die assembly 42. In the conventional die using lubrication, the scale is carried to bearing surface 24 where scoring of the die often precipitates premature failure of the die. In the embodiment of FIGS. 5 and 5*a*, the scale, not being carried by a lubricant, tends to collect in the tapered zone 23 and thence back up into the void or volume 53. As illustrated in FIG. 3, the void if formed by rim 34 extending around the perimeter of die 30, and slots 35 and 36 extend through rim 34. It will be seen that the scale collecting within die assembly 42 may escape through the slots and an adjacent opening in die holder 31. Similar construction of die holder 44 provides for excape of scale through appropriate exit points.

Die holder 31 and its alternative embodiment of FIG. 5*a*, provide for the stabilizing of drawing die 20 and well as guiding wire 33 at the entrant to die 20. Additionally it has been found that the use of an adjacent pressure die or integral die holder stabilizes the temperature of the die assembly thereby prolonging the life of the drawing die 20.

From the foregoing it will be understood that relatively wide modifications can be made in the configuration of the drawing die and the die holder assembly without departing from the essential spirit of this invention, which is intended to be limited only by the following claims.

I claim:

1. An integral self-lubricating wire-drawing die for reducing the diameter of wire to obtain a wire of smaller cross-sectional area, said die being receivable within the die receiving recess of a wire drawing machine, said die comprising:

an integral non-metallic die formed of ceramic material, said die having a size and configuration for establishing a close fitting relation within said die receiving recess; said die having a passage therethrough, said passage comprising a frusto-conical approach zone with an included angle of from about 17° to 30° ; said passage have a bearing zone adjacent to and forming a continuation of said approach zone, said bearing zone being of generally cylindrical configuration and measuring in length along said passage approximately 30 percent of the minimum diameter of the bearing zone; and said passage having a back relief zone at the exit of said passage, said back relief zone having an included angle of approximately 45° .

2. An integral, self-lubricating wire-drawing die apparatus for reducing the diameter of wire to obtain wire of a smaller cross-sectional area, said die being receivable within a die receiving recess of a wire-drawing machine, said die comprising:

a unitary integral die formed of ceramic material, said die having a size and configuration such that a close fitting relationship is established between said die and said die receiving recess;

a wire drawing passage is defined by said die, said passage having a tapered approach zone with an included angle of from about 17° to 30° , and a bearing zone of generally cylindrical configuration, said bearing zone having a length of about 30 percent of the minimum diameter of said passage; and die holder means for restraining said die from excessive movement within said die receiving recess.

3. A wire-drawing die apparatus for reducing the diameter of wire to obtain wire of a smaller cross-sectional area, comprising:

a tapered approach zone with an included angle of from about 17° to about 30° ; a bearing zone with approximately parallel sides, said bearing zone having a length of about 30 percent of the minimum diameter of said passage; and die holder means for restraining said die from excessive movement.

4. The wire-drawing apparatus of claim 3 wherein said die holder means comprise a housing for engaging said die over substantially the entirety of outer perimeter of the opposing surfaces of said die which surfaces are normal to the direction of wire travel.

5. The wire-drawing die apparatus of claim 3, wherein said die holder means comprises:

a pressure die for engaging said wire-drawing die along the outer perimeter of the downstream surface of said die, said surface being normal to the direction of wire travel; and a housing for holding said wire drawing die and said pressure die in firm engagement, said pressure die engaging said wire drawing die over substantially the entirety of the outer perimeter of the downstream surface of said wire-drawing die, which surfaces are normal to the direction of wire travel.

6. The wire drawing apparatus of claim 3 wherein said wire-drawing die includes a tapered back relief zone, said zone having an included angle of about 45° .

7. The method of drawing wire for reducing its cross-sectional area, which comprises:

pulling said wire through a die formed of aluminum oxide and having a passage therethrough including a tapered approach zone of frusto-conical shape, said tapered approach zone having an included angle of from about 17° to about 30° and a bearing surface having a length of about 30 percent of the minimum diameter of of said passage; and pulling said wire through said die without providing any lubricant thereto.

8. The method of drawing wire for reducing its cross-sectional area, which comprises:

pulling said wire through a set of dies, said set of dies comprising a pressure die and a drawing die, said drawing die having a tapered approach zone with an included angle from about 17° to 30° and a bearing surface for maintaining uniform pressure upon the wire for a distance approximately equal to 30 percent of the drawn diameter of the wire; and pulling said wire through said set of dies without providing any lubricant thereto.

9. A self-lubricating wire drawing die for reducing the diameter of wire to obtain a wire of smaller cross-sectional area, said die being receivable within the die receiving recess of a wire drawing machine said die comprising an integral non-metallic die formed of aluminum oxide of from 70–99.9% purity wherein lubrication of said die is eliminated, said die being of a size and configuration for close fitting relationship within said die receiving recess, said die having a wire drawing passage therethrough including a tapered approach zone with an included angle of between about 17° and 30° to thereby reduce wear on said die; and said die having a bearing surface forming a continuation of said tapered zone, said bearing surface having approximately parallel sides with a length along said passage of approximately 30% of the minimum diameter of said bearing zone.

10. The wire drawing die of claim 9, wherein said passage includes a back relief zone at the exit of said passage.

11. The wire drawing die of claim 10, wherein the included angle of said back relief zone is approximately 45°.

* * * * *